United States Patent [19]

Harris, Jr.

[11] Patent Number: 4,573,645

[45] Date of Patent: Mar. 4, 1986

[54] RIBBON TENSION CONTROL

[75] Inventor: Samuel C. Harris, Jr., Waynesboro, Va.

[73] Assignee: Genicom Corporation, Waynesboro, Va.

[21] Appl. No.: 554,736

[22] Filed: Nov. 23, 1983

[51] Int. Cl.[4] ..... B65H 77/00

[52] U.S. Cl. ..... 242/75.47; 242/186; 318/7

[58] Field of Search ..... 242/75.47, 75.46, 75.45, 242/75.51, 191, 187, 186; 318/7, 318, 329; 360/71

[56] References Cited

U.S. PATENT DOCUMENTS

| | | | |
|---|---|---|---|
| 3,733,529 | 5/1973 | Ross et al. | 242/75.44 X |
| 3,764,087 | 10/1973 | Paananen et al. | 242/191 X |
| 3,928,844 | 12/1975 | Meihofer | 242/57 X |
| 3,984,868 | 10/1976 | Ragle et al. | 242/186 X |
| 4,125,881 | 11/1978 | Eige et al. | 360/50 |
| 4,157,488 | 6/1979 | Allan | 318/7 |
| 4,259,996 | 3/1981 | Brooks et al. | 242/186 X |
| 4,366,405 | 12/1982 | Schmider | 318/318 X |
| 4,370,683 | 1/1983 | Greig et al. | 242/186 X |
| 4,404,509 | 9/1983 | Hartwig | 318/318 X |
| 4,448,368 | 5/1984 | Skalko | 242/186 |
| 4,479,081 | 10/1984 | Harris | 318/7 X |
| 4,497,459 | 2/1985 | Yoshino et al. | 318/7 |

*Primary Examiner*—Stephen Marcus
*Assistant Examiner*—Leo James Peters
*Attorney, Agent, or Firm*—Cushman, Darby & Cushman

[57] ABSTRACT

A ribbon tension control for controlling the tension of ribbon traveling between a rotating supply spool and a rotating take-up spool varies the amount of braking torque applied to the supply spool to hold ribbon tension constant as the distribution of ribbon between the spools changes. A generator rotationally coupled to the supply spool produces braking torque to resist the rotation of the spool when the generator windings are electrically loaded. The loading of the generator is controlled by processing feedback signals emitted by the generator to provide periodic load switching signals. Processing of the feedback signal is accomplished in the exemplary embodiment by a drag lookup table which is addressed by the feedback signal. The drag lookup table produces a duty cycle value which is used to determine the duty cycle of the switching signal, which, in turn, controls the electrical loading of the generator. Because electrical loading of the generator at the switching signal rate modulates the feedback signal which it emits, the period of the switching signal is sufficiently different from that of the feedback signal to permit separation of the feedback signal from the switching signal.

27 Claims, 10 Drawing Figures

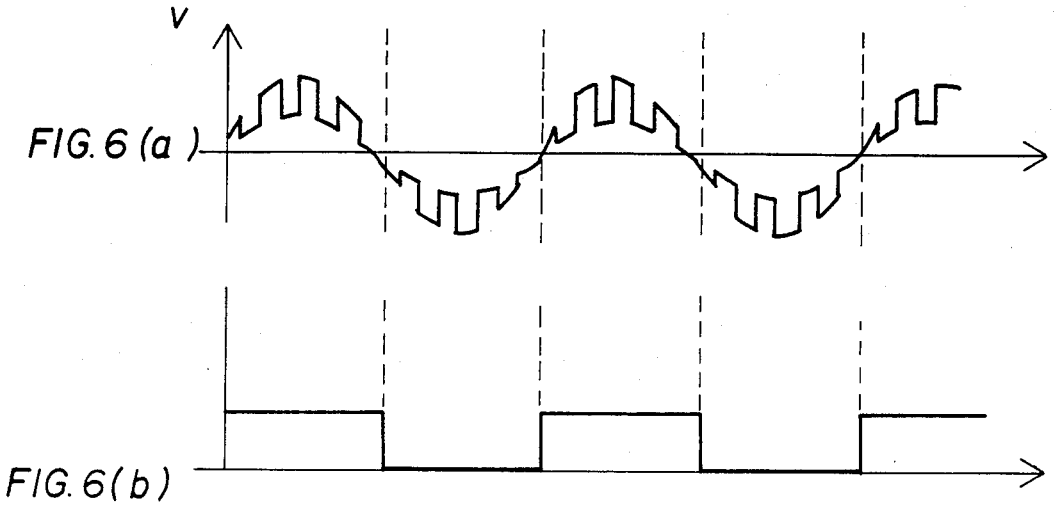
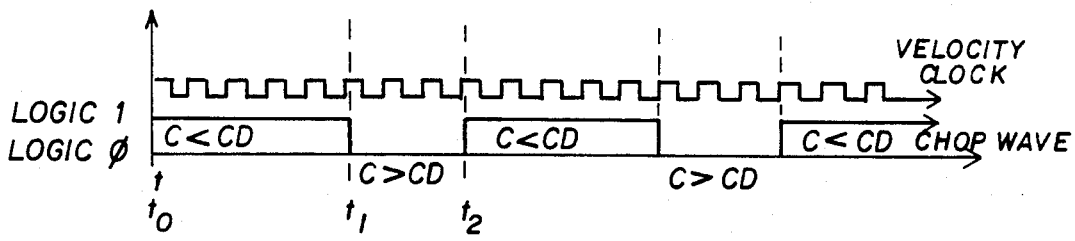
FIG. 7

RIBBON TENSION CONTROL

CROSS-REFERENCE TO RELATED APPLICATIONS

This application is related to copending U.S. applicater Ser. No. 494,350, now U.S. Pat. No. 4,479,081, to Harris entitled "STEP MOTOR DRIVE", filed May 13, 1983. This application is also related to my following copending commonly-assigned U.S. patent applciations: Ser. No. 399,129 now abandoned and Ser. No. 399,130 now U.S. Pat. No. 4,468,140, both filed July 16, 1982; and Ser. No. 399,216 now U.S. Pat. No. 399,216, filed July 19, 1982.

FIELD OF THE INVENTION

The present invention is related to controlling the linear movement of a web or tape between spools or reels. In particular, the present invention is useful in controlling the transport of ribbon past a print head in connection with impact printing of symbols onto a record medium.

BACKGROUND OF THE INVENTION

A common form of linear speed control for a moving web as used, for example, in tape and ribbon transports, employs a constant speed capstan pinch roller drive. Where constant ribbon velocity is required in such transports, a special drive is required for the takeup reel and the payout reel as well as for the pinch roller in order to attain reasonable precision in the control of the surface velocity of the tape. Added complications arise when the web has to be driven bidirectionally at high speed. Heretofore, the use of a pinch roller has provided certain disadvantages, as, for example, problems in maintaining the proper ribbon tension during ribbon movement, and improper tracking of the ribbon with respect to the head (particularly where the ribbon has substantial width).

Proper ribbon tension in such tape and ribbon transports is often critical. For example, in an impact printer with a moving print head having an inked ribbon suspended between the print head and a record medium (such as paper) by two guides (located on either side of the printer), the ribbon must be suspended at a proper constant tension. Insufficient ribbon tension may result in the ribbon being caught in the print wires of the print head and dragged along with the head. Excessive ribbon tension, on the other hand, can cause stalling of the ribbon take-up spool, curling or improper winding of the ribbon onto the take-up spool, or breakage of the ribbon.

Friction guides have sometimes been used in the past to provide required ribbon tension. Friction guides, however, have several disadvantages. For example, friction guides tend to collect dried ink, causing the ribbon to adhere to the guides; ribbon tension varies with friction guide wear; and the friction guides can interfere with the correct spooling of the ribbon onto the take-up spool.

Now, however, I have discovered an improved control for providing constant ribbon tension as well as constant surface velocity of a moving web or tape. As implemented in the exemplary embodiment, it requires a lesser number of mechanical components to provide simultaneous linear velocity and tension control. This exemplary embodiment is, for example, useful in providing a linear velocity and tension control for use with an inked ribbon having substantial width. And it may provide constant ribbon tension for a moving ribbon suspended between a print head and a record medium.

SUMMARY OF THE INVENTION

In accordance with a first (speed control) aspect of one presently preferred embodiment of the invention (as originally claimed in parent application Ser. No. 494,350), step motors and a digital controller are employed to eliminate the necessity of a capstan drive. By making use of feedback pulses emitted from the payout or supply spool step motor as it is rotated during tape movement, a closed-loop digital system is provided to regulate the tape speed and tension with sufficient accuracy for many applications (for example, high speed impact printing).

Speed regulation is obtained by processing the feedback pulses to provide drive step pulses for a takeup step motor. The rate of the drive step pulses is controlled as a function of the feedback pulse rate. The digital control uses a function table which is contained in a read only memory (ROM). This ROM is addressed by the number of feedback pulses emitted during a sample period determined by a predetermined number of takeup step pulses. The predetermined number of takeup step pulses and the number of function table entries are selected consistent with desired accuracy and resolution requirements.

In accordance with a second (ribbon tension control) aspect of this invention (as claimed in this application), constant ribbon tension control is provided by a dynamic braking system simultaneously utilizing the payout reel or supply spool step motor (discussed above) as a dynamic brake. The electrical output of the payout or supply spool step motor is selectively connected to an adjustable electrical load to cause the step motor to produce braking torque to resist the rotation of the payout reel. The adjustable loading is modulated or controlled by processing the feedback pulses emitted from the payout reel step motor during the sample period to provide a periodic switching signal. The duty cycle of this periodic switching signal then, in turn, controls the degree of braking torque produced by the payout step motor (i.e. the brake modulation is determined by the relative levels of ribbon piled on the two spools).

Processing the feedback pulses is, in the exemplary embodiment, accomplished simply by a drag lookup table: a ROM which is addressed (like the other function table in ROM already discussed above) by the number of feedback pulses emitted during the sample period. The drag lookup table produces digital signals representing a duty cycle value which is then used to control the duty cycle of the periodic load switching signal.

Because electrical loading of the payout or supply step motor at the switching signal rate necessarily also modulates the feedback pulses emitted by the supply step motor, the period (i.e. the frequency of the associated signal components) of the switching signal may preferably be sufficiently different from that of the feedback pulses to permit the use of simple frequency-selective filtering to separate the desired feedback pulses from the effects of the switching signal.

While the control logic for the present invention might be straightforwardly implemented with common hardwired logic elements (that is, gates, counters, etc.), the presently preferred exemplary embodiments of the present invention here discussed utilize straightforwardly programmed microprocessor systems having essentially conventional hardware architecture except for the aspects disclosed in more detail herein.

These as well as other objects and advantages of the present invention will be better appreciated and understood by reference to the following detailed description of the presently preferred exemplary embodiments taken in conjunction with the accompanying drawings.

BRIEF DESCRIPTION OF THE DRAWINGS

FIGS. 6(A)–6(B) graphically illustrate the output of the payout step motor and the count pulse signals generated by the presently preferred embodiment of the invention shown in FIG. 5; and FIG. 7 graphically illustrates the clock and the chop wave signals generated by the presently preferred embodiment of the present invention shown in FIG. 5.

DETAILED DESCRIPTION OF THE PREFERRED EXEMPLARY EMBODIMENTS

Figure 1:
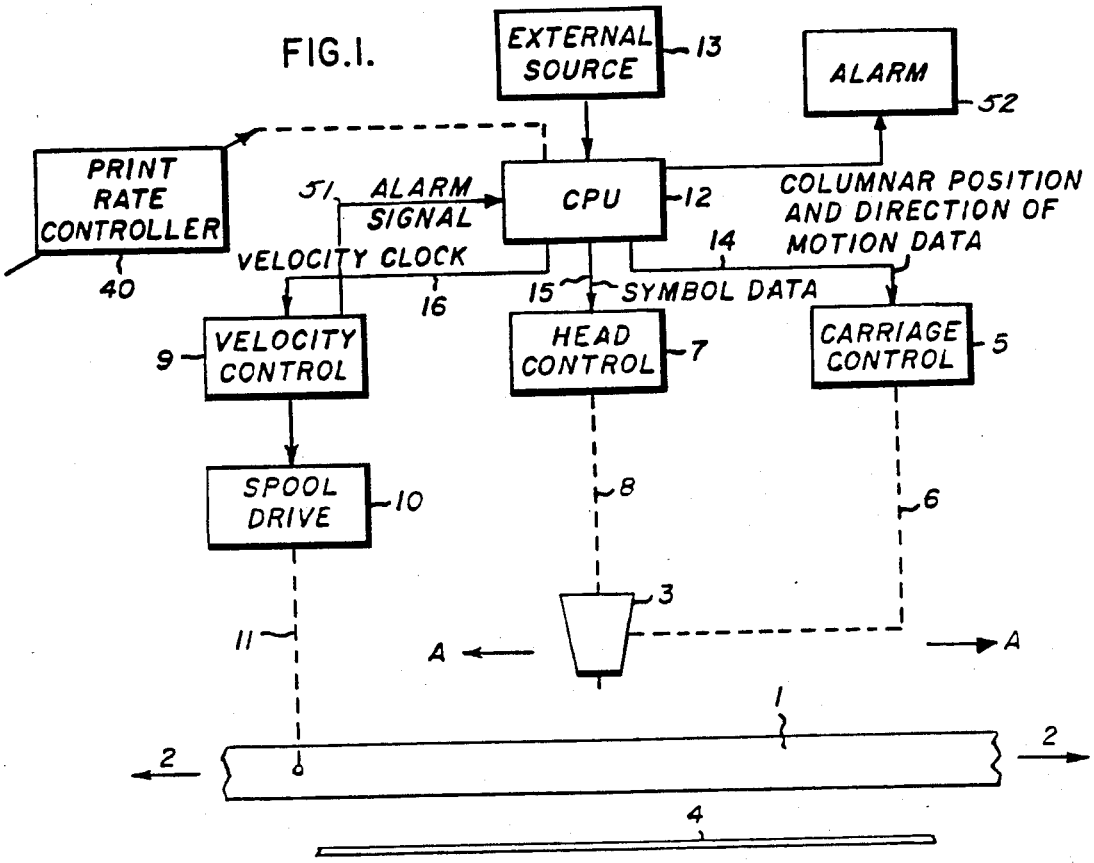
FIG. 1 illustrates schematically a tape transport arrangement in accordance with the present invention for moving tape at a constant linear speed past a print head for effecting printing at desired column locations along the print line.

Referring to FIG. 1, there is shown a ribbon 1 required to be moved linearly at constant speed in either direction (as indicated by direction arrows 2) past a print head 3 such that upon application of signals to be printed, portions of the print head (suitably, for example, individual print wires of a wire matrix print head) impact a record medium 4 (such as paper) through ribbon 1 to print desired symbols. In the arrangement shown in FIG. 1, movement of print head 3 is controlled by carriage control 5 (the control is depicted by coupling 6). Head control 7 controls the operation of print head 3 through coupling 8. Movement of the ribbon 1 is controlled by velocity control 9 acting through the spool drive unit 10 and the coupling 11.

Carriage control 5, head control 7 and spool drive 10 suitably comprise step motors acting through the interconnections 6, 8 and 11, respectively (as previously described), under the control of pulses generated within carriage control 5, head control 7 and spool drive 10 in response to data furnished from a central processing unit (CPU) 12. Central processing unit 12 responds to information received from data communication source 13, suitably to provide column position and direction-of-motion data over link 14 to carriage control 5, symbol data to the head control 7 over link 15, and velocity data to velocity control 9 over link 16. In this manner, information received from the external source 13 is processed to provide drive information to obtain the desired coordination of linear ribbon movement, linear velocity head movement and the proper impacting of print wires of print head 3 through ribbon 1 onto the record medium to print the desired symbols in the desired columns.

Figure 2:
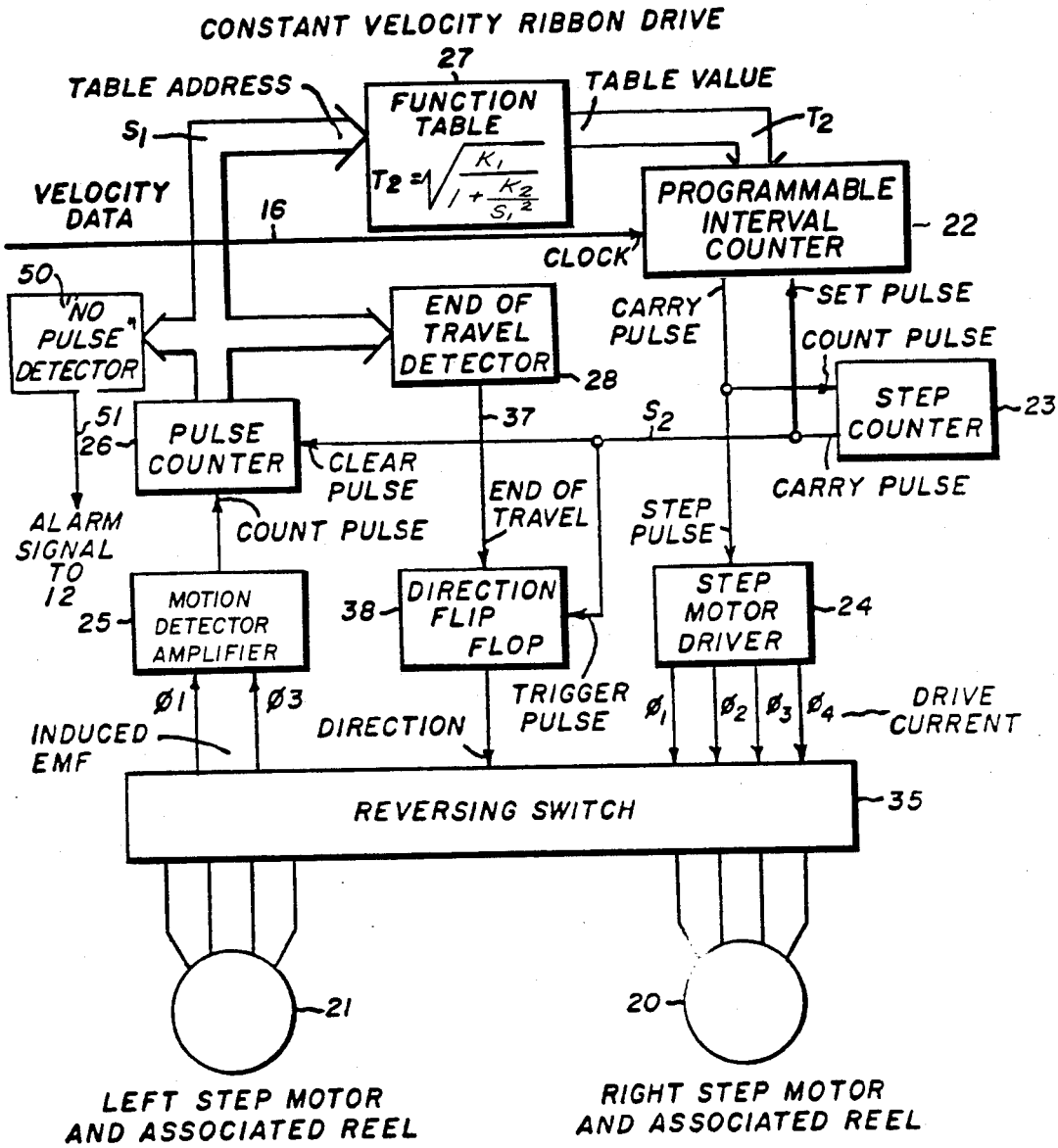
FIG. 2 is a block diagram of a presently preferred exemplary embodiment of the invention.

Referring to FIG. 2, there is shown a detailed block diagram of the velocity control 9 and spool drive control 10 shown in FIG. 1 in accordance with one presently preferred exemplary embodiment of the present invention. Wherever appropriate, the symbols used in FIG. 1 are retained in FIG. 2 (and in later FIGURES as well). Thus, for example, in the case where the ribbon 1 is traveling from left to right, the right step motor 20 operates as the drive motor for rotating ribbon onto its associated spool (the take-up spool) from the spool associated with the left step motor 21 (the payout or supply spool). Motor 21 (i.e. the supply spool motor) also acts as a feedback transducer, as will be described shortly.

For assumed left-to-right ribbon movement, spool drive 10 shown in FIG. 1 comprises the step motor driver 24, reversing switch 35 and the right step motor and associated spool 20. Velocity control 9 shown in FIG. 1 comprises programmable interval counter 22, step counter 23, the left step motor 21 (here mechanically driven to act as an electrical signal generator feedback transducer), motion detector amplifier 25, pulse counter 26 and function table 27. The end-of-travel detector 28 and direction flip-flop 38 also comprise part of the spool drive 10 shown in FIG. 1, as will be described later.

Figure 3:
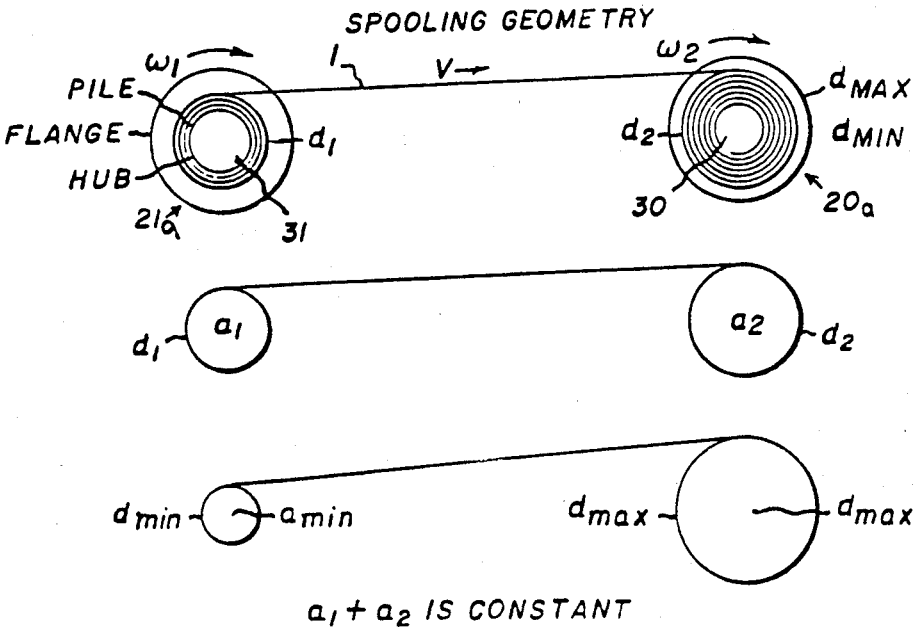
FIG. 3 graphically illustrates certain geometry useful in explaining how the step interval for the takeup spool is related to the displacement of the supply spool.

FIG. 3 illustrates the basic geometry involved in a reeling mechanism. By applying the basic relationships given here, an expression for the step angular velocity of the take-up spool, spindle as a function of the supply spindle angular velocity may be derived. Take-up spool 20*a* is a part of the right step motor and associated reel 20 shown in FIG. 2 when ribbon 1 moves from left to right. As shown in FIG. 3, a substantial amount of ribbon 1 is wound up on hub 30 of the spool 20*a*, while a reduced amount of ribbon remains on hub 31 of supply spool 21*a*. The diameter of the pile of ribbon 1 on take-up spool 20*a* is shown as $d_2$, and the diameter of the pile of ribbon remaining on supply spool 21*a* is shown as $d_1$. The angular velocity of each of spools 20*a* and 21*a* will, of course, vary as a function of the distribution of ribbon 1 between the spools; this angular velocity changes as ribbon 1 is spooled from supply spool 21*a* (at the desired constant linear velocity) onto the take-up spool 20*a*.

Obviously, because the total mass of ribbon 1 remains constant, the sum of the cross-sectional areas $a_1$ and $a_2$ of the ribbon piles remains constant. Since area is proportional to the square of the diameter (area is given by $\pi r^2$), the sums of the squares of the diameters $d_1$ and $d_2$ remains constant. The linear velocity V of the ribbon 1 is equal to the diameter of one of these spools multiplied by the angular velocity of the same spool (for either spool). The relationship between the angular velocities of the two spools is thus given as $V=d_1 \cdot w_1=d_2 \cdot w_2$ (where $w_1$ and $w_2$ are the angular velocities in radians per second of supply spool 21*a* and take-up spool 20*a*, respectively).

Thus, the desired angular velocity $w_2$ of the driving spool can be obtained by carrying out the following calculation:

$$\frac{\pi d_1^2}{4} + \frac{\pi d_2^2}{4} = a_1 + a_2 = A \quad (1)$$

(where A is the combined total area of the ribbon piles).

Where $d_{max}$ and $d_{min}$ are the pile diameters of full and empty spools, respectively, and $a_{max}$ and $a_{min}$ are the areas of those piles, respectively, the following is true:

$$\frac{\pi d^2_{max}}{4} + \frac{\pi d^2_{min}}{4} = a_{max} + a_{min} = A \quad (2)$$

Since the sum of the cross-section areas $a_1$ and $a_2$ remains constant, as mentioned above, the following is true:

$$d_1^2 + d_2^2 = d_{max}^2 + d_{min}^2 \quad (3)$$

As stated above, $$V = d_1 \cdot w_1 = d_2 \cdot w_2 \quad (4)$$

where V is the linear velocity of the ribbon, $w_1$ is the angular velocity of the supply spool 21*a*, and $w_2$ is the angular velocity of take-up spool 20*a*. Equation 4 may be rewritten as:

$$d_1 = \frac{V}{w_1} \text{ and} \quad (4a)$$

$$d_2 = \frac{V}{w_2} \quad (4b)$$

Substituting equations 4*a* and 4*b* into equation 3 and solving for $w_2$ yields:

$$w_2 = ((1/V^2) \cdot (d_{max}^2 + d_{min}^2 - (V/w_1)^2))^{-\frac{1}{2}} \quad (5)$$

From the angular velocity, an expression for the step interval as a function of feedback pulse count accumulated in a drive step sample may be developed as follows:

$$w = \frac{d\theta}{dt} \quad (6)$$

(where $\theta$ is the angular displacement of a spool spindle).

To apply the expression just derived from FIG. 3 to digital control techniques which use discrete increments rather than continuous variables, a finite difference expression representing the angular velocity of the spools will be used:

$$\frac{d\theta}{dt} = \frac{\Delta\theta}{\Delta t} \quad (7)$$

The value of $\Delta\theta$ for a particular application will be determined by accuracy and resolution requirements, That is, for coarse control applications (employing a large sample period), $\Delta\theta$ would be large; for a fine control application (employing a small sample period), $\Delta\theta$ would be small. For convenience, $\Delta\theta$ shall be designated S and $\Delta\theta$ shall be designated T.

If $\Delta\theta$ is set to be equal to the displacement of a spool for one step of its associated step motor and the step interval time corresponding to this step is designated T, then $$w_1 = \frac{1}{T_1} \text{ and} \quad (8a)$$

$$w_2 = \frac{1}{T_2} \quad (8b)$$

(where $w_1$ and $w_2$ are in steps per second).

For any given sample period, $T_s$ $$\frac{S_1}{S_2} = \frac{w_1 T_s}{w_2 T_s} \quad (9)$$

(where $S_1$ is the number of steps of step motor 21 and $S_2$ is the number of the steps of step motor 20 taken during time $T_s$).

Therefore, $$w_1 = \frac{w_2 S_1}{S_2} \quad (10)$$

$$= \frac{S_1}{S_2 T_2} \quad (11)$$

Substituting now for $w_1$ and $w_2$ in equation 5, $$T_2 = \sqrt{\frac{1}{V^2}(d_{max}^2 + d_{min}^2) - \left(\frac{S_2 T_2}{S_1}\right)^2} \quad (12)$$

$$= \sqrt{\frac{(d_{max}^2 + d_{min}^2)}{V^2 \cdot (1 + (S2/S1)^2)}} \quad (13)$$

Thus, for $S_2$, V, $d_{max}$ and $d_{min}$ constant, an expression for the period $T_2$ between driving steps on the take-up spool is given by:

$$T_2 = \sqrt{\frac{K_1}{1 + K_2/(S1)^2}} \quad (14)$$

(where $T_2$ is the step interval for the take-up spool 20*a* and $T_1$ is the displacement of the supply spool 21*a* for a constant sample internal, $S_1$.

Referring once again to FIG. 2, the function table 27 provides at its output the value $T_2$ as a function of the feedback sample $S_1$ available from pulse counter 26. Thus, $S_1$ is derived from the feedback signals available from the step motor 21 and $T_2$ is used to drive the step motor 20 for spooling ribbon 1 from the left to right.

Referring to FIG. 1, in the presently preferred exemplary embodiments of the invention, a microcomputer (suitably an Intel 8085) is employed as the heart of CPU 12. Such a microcomputer is suitably programmed to generate 3 outputs, one on each of links 14, 15 and 16, in response to data supplied to it by external source 13. Data supplied by external source 13 to CPU 12 is suitably in serial or parallel ASCII format. CPU 12 is suitably programmed (in a conventional manner) to respond to print symbols and function commands available from external source 13 to advance print head 3 under control of carriage control 5, to activate desired print wires of the print head at the columnar positions defined by carriage control 5, and to provide velocity clock data to velocity control 9.

Referring to FIG. 2, a reversing switch 35 connects one of step motors 20 and 21 to motion detector amplifier 25, establishing the step motor so connected as the supply spool feedback generator; the other one of step motors 20 and 21 is connected to step motor driver 24, establishing that step motor as the drive motor for the take-up spool. Step motor driver 24 (suitably a polyphase step motor driver of conventional design) responds to step pulses (such as those is shown in FIG. 4(*a*)) available from the carry pulse output of the programmable interval counter 22 to switch the motor windings of the step motor connected to it in a rotating phase sequence to advance the motor in steps (in a conventional manner).

The modulus of programmable interval counter 22 (i.e. the number of pulses which it counts before it generates a carry output) is set by the output $T_2$ of function table 27 every time the programmable interval counter carries (i.e. counts up to its modulus). These step pulses from programmable interval counter 22 are also accumulated by a step counter 23. The count modulus of step counter 23, therefore, determines the step sample period for which the function table is designed.

Figure 4:
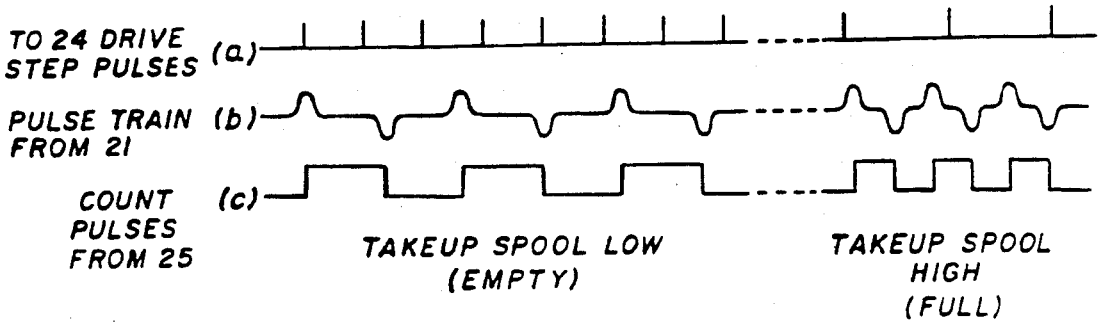
FIGS. 4(A)–4(C) graphically illustrate certain signals useful in explaining the orientation of the preferred embodiment shown in FIG. 2.

Referring to FIGS. 2, 4(*b*) and 4(*c*), as the take-up motor 20 is driven to pull ribbon 1 (for ribbon movement from left to right), supply spool motor 21 acts as a permanent magnet alternator. The signal generated by supply reel motor 21, shown in FIG. 4(*b*), is applied through reversing switch 35 to motion detector amplifier 25 (which functions as a pulse shaping circuit). Motion detector amplifier 25 produces count pulses, as is shown in FIG. 4(*c*) (suitably at switching logic levels), to drive a pulse counter 26. FIGS. 4(*a*)–4(*c*) show that as ribbon 1 is wound onto the take-up spool 20, both the drive step pulse interval (i.e. the output of programmable interval counter 22), and the feedback pulse rate (i.e. the output of motion detector amplifier 25) and its resultant pulse count (i.e. the output, not shown, of pulse counter 26) increase to maintain a constant linear velocity of tape movement, the increase being governed by function table 27.

Referring to FIG. 2, the output of pulse counter 26 addresses the function table 27 with signal $S_1$. A carry pulse generated by step counter 23 at the end of the step sample period clears the pulse counter 26 over lead $S_2$. The pulse counter 26 accumulation, therefore, is a function of the ratio of the angular velocity of the supply spool to the angular velocity of the take-up spool. By placing the count value $S_1$ (as derived earlier) into the function table 27, the appropriate step period $T_2$ is continually applied to the programmable interval counter 22 to maintain the ribbon movement at constant velocity.

As the pile on the supply reel 21 decreases and the pile on the take-up reel 20 grows, the accumulated pulse count of pulse counter 26 for each step sample increases. To detect the approaching end of the supply pile, an end-of-travel signal is emitted over lead 37 by the end of travel detector 28 when the pulse count reaches a predetermined limit value established in the end of travel detector 28. This end-of-travel signal complements a direction flip-flop 38, which operates the reversing switch 35 to exchange the roles of the step motors 20 and 21.

Another problem that arises in impact printing through ribbon 1 is when the ribbon jams or breaks. It is important to stop the printing process and signal an alarm upon such an occurrence. Referring to FIGS. 1 and 2, according to another feature of the presently preferred exemplary embodiment of the present invention, a "no pulse" detector 50 detects the absence of an output from pulse counter 26, which would arise when the supply spool no longer turns as a result of ribbon jamming or breakage. In this condition, no induced EMF is supplied to motion detector amplifier 25, and hence no counting takes place in pulse counter 26. Upon detection of a "no pulse" count, no pulse detector 50 applies an alarm signal over lead 51 to CPU 12. CPU 12 responds by suspending operation of carriage controls 5, head control 7 and velocity control 9, and hence suspends printing action. CPU 12 also sends an alarm signal to alarm 52 to alert the operator. Thus, the feedback arrangement provided enables a multiplicity of useful functions to be performed and insures adequate printing operation and control.

Referring to FIGS. 1 and 2, the velocity reference frequency (clock signal frequency) is supplied over lead 16 from the CPU 12 to the programmable interval counter 22 of velocity control 9. The clock is of a constant frequency for a constant velocity. If ribbon velocity variation is desired (in order, for example, to accommodate a change in the desired symbol print rate), the clock frequency may be programmed into CPU 12 by the print rate controller 40. In the presently preferred exemplary embodiment of the present invention, the velocity clock signal generated by CPU 12 is suitably a periodic free-running clock signal operating at 10 kilohertz. The modulus of step counter 23 (set by $T_2$, the output of function table 27) may suitably be 25 for a given distribution of ribbon between supply spool 21 and take-up spool 20 (in other words, when programmable interval counter 22 counts 25 clock pulses, it resets to zero and generates a carry pulse to provide a step pulse to step motor driver 24). The modulus of step counter 23 (which may suitably be 75) establishes the sample period $T_s$. Step counter 23 produces a carry pulse output to reset programmable interval counter 22 and pulse counter 26.

Figure 5:
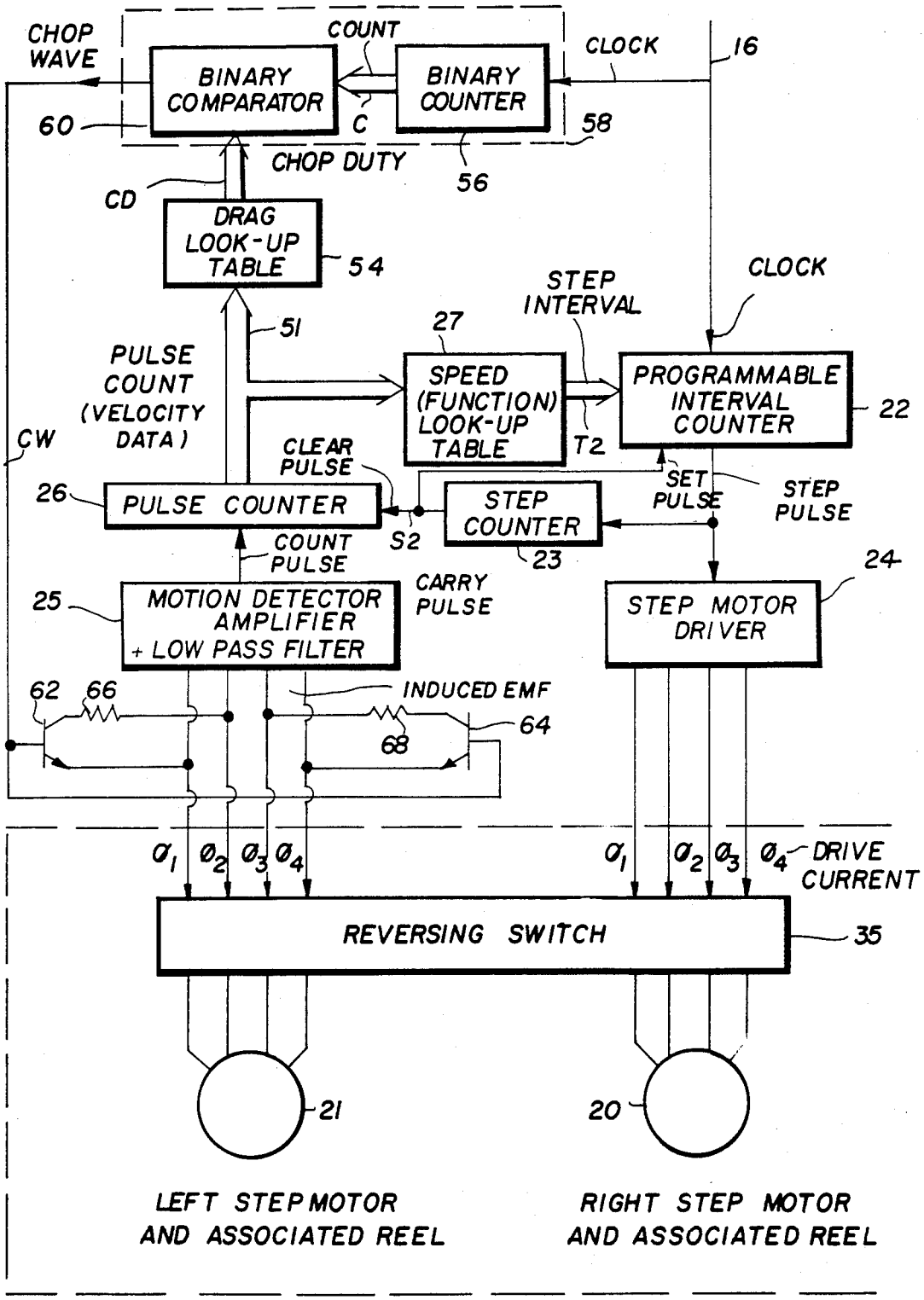
FIG. 5 is a block diagram of another presently preferred exemplary embodiment of the present invention which controls ribbon tension as well as ribbon velocity.

Referring to FIG. 5, another presently preferred exemplary embodiment of the present invention which also provides tension control is shown. The embodiment shown employs a modulated dynamic braking arrangement coupled to the supply spool, the degree of modulation being determined by the level of the pile of ribbon 1 on the spool. As before, reversing switch 35 selects one of step motors and associated reels 20 and 21 as the supply spool and the other as the take-up spool, as determined by the desired direction of ribbon travel (left-to-right or right-to-left). In the arrangement shown, the left step motor and associated reel 21 is assumed to have been selected as the supply spool, while right step motor and associated reel 20 is assumed to have been selected as the take-up spool (thus, ribbon 1 travel is from left-to-right).

Step motor 21 (suitably a permanent magnet step motor) functions as a generator when its output shaft is driven mechanically. Dynamic braking may be effected by electrically loading the windings of step motor 21 (suitably with resistive electrical loads such as fixed resistances). When the electrical windings of step motor 21 are electrically loaded the step motor will produce braking torques to resist the rotation of associated supply spool 21*a*, thus applying tension to ribbon 1.

The amount of force exerted on ribbon 1 by a given torque appearing at the output shaft of either left step motor 21 or right step motor 20 varies as a function of diameter of the ribbon pile ($d_1$ and $d_2$, respectively) of the spool associated with the step motor. Thus, the amount of braking torque which left step motor 21 must produce to maintain a desired constant tension on ribbon 1 must be varied as a function of the instantaneous diameter of the piles of ribbon 1 on supply spool 21*a* as the distribution of ribbon on the spools changes. As previously discussed, the number of steps $S_1$ of step motor 21 during a given sample period $T_s$ is a function of the ratio of the angular velocity of the supply spool to the angular velocity of the takeup spool. $S_1$ in turn is a function of the diameter of the ribbon pile on the supply spool for constant linear ribbon velocity V.

The braking torque exerted by left step motor 21 is suitably varied by selectively switching resistors 66 and 68 across the electrical windings of the step motor. Switching of resistors 66 and 68 across their respective windings of left step motor 21 is performed by switching transistors 62 and 64, respectively. The bases of transistors 62 and 64 are connected together and an excitation voltage is applied to the common bases to cause the transistors to conduct simultaneously.

The resistive loading of the windings of left step motor 21 cannot be allowed to affect the feedback pulses which it also generates to the input of motion detector amplifier 25, since these feedback pulses (which indicate the angular velocity of the supply reel 21*a*) are suitably used not only to determine the braking torque applied by left step motor 21 (as will be discussed later), but also to control the step rate of right step motor 20 to maintain desired ribbon velocity. To prevent the resistive loading from affecting the count pulse output of motion detector amplifier 25, the resistors 66 and 68 are suitable intermittently switched across respective windings of left step motor 21 by operating switching transistors 62 and 64 in a high frequency chopper mode with a controlled on-to-off ratio (i.e. chopper duty cycle). A chopper frequency is selected such that filtering of the chopper frequency from the feedback pulses can be accomplished with a minimum of added complexity to motion detector amplifier 25 (suitably by a simple frequency-selective filter as schematically depicted in FIG. 5).

FIGS. 6(*a*)–(*b*) are a graphic illustration of the pulse train shown in FIG. 4(*b*) generated by left step motor 21 as resistive loading is applied intermittently to the windings on left step motor 21 in accordance with a chop wave. As can be seen, a high frequency periodic chop wave is superimposed on the pulse train produced by left step motor 21. The amount of braking torque produced by left step motor 21 may be controlled by varying the duty cycle (i.e. the time during a given period in which resistors 66 and 68 are switched across their respective windings). FIG. 6(*b*) shows the filtered and shaped wave form at the output of the motion detector amplifier 25 (suitably a pulse shaping and low pass filter circuit).

Referring once again to FIG. 5, the function of the pulse counter 26, step counter 23, function table 27, programmable interval counter 22 and step motor driver 24 have already been discussed in explaining the exemplary embodiment shown in FIG. 2. Output $S_1$ from pulse counter 26 is also applied as an address input to a drag lookup table 54 (suitably another ROM in which is stored indicia of the degree of required braking as a function of the ratio of the angular velocity of the supply spool to the angular velocity of the takeup spool), which generates a digital chop duty (CD) output signal. The signal CD determines the duty cycle (i.e. the portion of a complete chop wave (CW) cycle during which a pulse is generated) of the chop wave.

Output CD of drag lookup table 54 is input to a chop counter 58, suitably comprising a binary counter 56 and a binary comparator 60. Also input to the chop counter 58 is a clock (velocity control) signal from line 16. The function of chop counter 58 is to generate a periodic, high-frequency chop wave CW the duty cycle of which is controlled by chop duty signal CD.

Binary counter 56 may have a predetermined fixed modulus which determines the frequency of the chop wave CW. Binary counter 56 is clocked by clock line 16 and produces at its output a count signal C (suitably a binary value several bits wide) indicating the count contained in the binary counter. Once the value of count signal C reaches the predetermined modulus of binary counter 56, the binary counter will reset and begin counting again from zero.

The magnitude of count signal C is compared by binary comparator 60 with the magnitude of chop duty signal CD generated by the drag lookup table 54. Referring to FIGS. 5 and 7, whenever the magnitude of count signal C is less than the magnitude of chop duty signal CD, an "on" level pulse (logic level 1) is produced at the chop wave output of binary comparator 60. Likewise, whenever the magnitude of count signal C is greater than the magnitude of chop duty signal CD, binary comparator 60 produces an "off" level (logic level 0) at its chop wave output. The total period of a complete cycle of the chop wave output CW is fixed (by the fixed predetermined modulus of binary counter 56) for a given frequency of clock signal present on clock line 16. Hence, the total chop wave period $t_2$ of chop wave signal CW (the sum of the time during which a logic level one is produced and the time during which a logic level zero is produced) is constant. However, the time $t_1$ during which a logic level one is produced in each period varies as a function of the magnitude of the chop duty signal CD produced by drag lookup table 54. Time $t_1$, in turn, determines the amount of braking torque exerted by left step motor 21 by modulating the resistive loading across the windings of the left step motor.

As mentioned previously, drag lookup table 54 is suitably a ROM containing a plurality of values of the chop duty CD, each value being located at an address corresponding to one of a plurality of a values of $S_1$. Because of the complexity of the spooling geometry coupled with the step motor characteristics for any given specific physical embodiment, an empirical development of values stored in drag lookup table 54 is suitably generated by simply empirically selecting the value of chop duty CD that yields the desired tension of ribbon 1 at the particular pulse count $S_1$ as the ribbon is transported from the supply spool 21*a* to the takeup spool 20*a* in a specific system design. For this purpose, the tension of ribbon 1 may be conventionally measused by a scale sensing loop placed between supply spool 21*a* and take-up spool 20*a*.

The presently preferred exemplary embodiment of the invention shown in FIG. 5 may be implemented as depicted by a microprocessor in order to reduce hardware costs and implementation time, although, as is understood by those skilled in the art, the embodiment could also be realized by a variety of other implementations, including those utilizing discrete components, large scale integration (LSI) integrated circuits, etc. Indeed, although only a few embodiments of this invention have been described in detail, those skilled in the art will readily appreciate that there are many ways to modify the disclosed system without losing many of the novel advantages, functions or results of this invention. Accordingly, all such modifications are intended to be included within the scope of this invention.

I claim:

1. A ribbon tension controller for controlling the tension of a fixed length of ribbon as it is transferred from a rotating supply spool to a rotating take-up spool, said ribbon tension controller comprising:

alternating current generator means coupled to said supply spool for producing braking torque to resist the rotation of said supply spool;

control means for producing a digital ribbon tension control signal related to the relative lengths of the fixed length ribbon then present on said spools; and dynamic electrical braking means for dynamically varying the braking torque produced by said generator means, said braking means including switching means, electrically coupled to said generator means and to an electrical load, for selectively coupling said load to said generator means in response to said digital control signal.

2. A controller as in claim 1 wherein said digital control signal produced by said control means bears a predetermined relationship to the ratio of the angular velocity of said supply spool to the angular velocity of said take-up spool.

3. A controller as in claim 2 wherein:

said control means includes means causing said digital control signal to be a periodic pulse train, the duty cycle of pulses in said pulse train being related to said predetermined relationship; and said switching means electrically connects said load to said generator means whenever a pulse is present in said pulse train.

4. A controller as in claim 1 wherein said generator means is an inactive device.

5. A controller as in claim 1 wherein said load comprises a passive resistive load.

6. A controller as in claim 5 wherein said switching means is electrically coupled to at least one winding of said generator means.

7. A tape transport apparatus for controlling the tension of a length of ribbon as it is transferred from a rotating supply spool to a rotating take-up spool, said apparatus comprising:

electrical drive means mechanically coupled to said take-up spool for rotating said take-up spool to wind said ribbon onto said take-up spool;

electrical alternating current generator means mechanically coupled to be driven by said supply spool for producing braking torque to resist the rotation of said supply spool;

electrical control means for detecting ribbon motion and for producing a corresponding digital ribbon tension control signal related to the desired ribbon tension; and digital switching means, electrically coupled to an electrical load and to said generator means, for varying the braking torque produced by said generator means by selectively connecting said load to said generator means in response to said digital control signal.

8. A tape transport apparatus as in claim 7 wherein:

said drive means produces a first digital signal indicating controlling the angular velocity of said take-up spool;

said generator means produces a second digital signal indicating the angular velocity of said supply spool; and said digital control signal produced by said digital control means bears a predetermined relationship to the ratio of said first and second signals.

9. A tape transport apparatus as in claim 8 wherein:

said digital control signal comprises a periodic pulse train, the duty cycle of pulses in said pulse train corresponding to said predetermined relationship; and said switching means electrically connects said load to said generator means whenever a pulse is present in said pulse train.

10. A tape transport apparatus as in claim 9 wherein:

the period of said periodic pulse train is substantially different from the period of said second signal; and said control means includes signal processing means for separating said second signal from modulated signals carried by said second signal and produced by said electrical loading of said generator means.

11. A tape transport apparatus as in claim 9 wherein said control means includes:

converting means for producing a chop duty signal corresponding to said predetermined relationship; and pulse train generating means responsive to said chop duty signal for producing said periodic pulse train.

12. A tape transport apparatus as in claim 11 wherein said pulse train generating means comprises:

counter means responsive to a periodic symmetrical square wave signal of predetermined frequency for counting the number of cycles of said square wave signal and for resetting said count after a predetermined elapsed number; and comparator means for producing a chop wave output based on a comparison of said chop duty signal and the count of said counter means.

13. A tape transport apparatus as in claim 11 wherein said converting means comprises a read only memory storing a plurality of values of said chop duty signal, one for each of a plurality of values of the ratio of said first and second signals.

14. A tape transport as in claim 7 wherein:

said generator means includes at least one electrical winding; and said load means includes at least one resistive element and at least one switching element which is responsive to the pulses of said periodic pulse train for cyclically connecting said resistive element across said electrical winding.

15. A tape transport apparatus as in claim 14 wherein said electrical winding is not supplied with electrical current.

16. A controller as in claim 7 wherein said load comprises a passive resistive load.

17. A controller as in claim 16 wherein said switching means is electrically coupled to at least one winding of said generator means.

18. A tape transport apparatus for controlling the tension of a length of ribbon as it is transferred from a rotatable supply spool to a rotatable take-up spool, said apparatus comprising:

means for generating a first electrical signal;

drive means rotationally coupled to said take-up spool for winding said ribbon from said supply spool onto said take-up spool at a linear velocity proportional to said first electrical signal;

alternating current generator means rotationally coupled to said supply spool for producing a second electrical signal at an output thereof proportional to the angular velocity of said supply spool and for producing braking torque to resist the rotation of said supply spool;

control means responsive to said first and second signal for producing a third electrical signal proportional to the ratio of the angular velocity at which said supply spool is rotating to the angular velocity at which said take-up spool is being controlled to rotate;

periodic signal generating means responsive to said third signal for producing a first periodic pulse train, the duty cycle of the pulses of said pulse train bearing a predetermined relationship to said third signal;

electrical load means for resisitively loading said generator means causing said generator means to produce braking torque; and switch means for connecting said load means to said generator means when a pulse of said periodic pulse train is present.

19. A tape transport apparatus as in claim 18 wherein:

said second signal is also cyclic but the signal frequencies associated with said first periodic pulse train are substantially different from the signal frequencies associated with said second signal; and said control means includes frequency selective filter means for filtering said second signal from modulations of said second signal produced by said electrical loading of the generator means.

20. A tape transport apparatus as in claim 18 wherein said periodic signal generating means comprises:

converting means for producing a fourth electrical signal corresponding to said predetermined relationship; and pulse train generating means responsive to said fourth signal for producing said periodic pulse train.

21. A tape transport apparatus as in claim 20 wherein said pulse train generating means comprises:

counter means, responsive to a clock signal of predetermined frequency for counting the number of cycles of clock signal and for resetting said count after a predetermined number of said cycles have been counted; and comparator means for producing a pulse based on a comparison of said fourth signal and the count of said counter means.

22. A tape transport apparatus as in claim 20 wherein said converting means comprises a read only memory storing a plurality of possible values for said fourth signal, one for each of a plurality of values of said third signal.

23. A tape transport apparatus as in claim 22, wherein said plurality of values of said fourth signal are developed empirically.

24. A tape transport apparatus as in claim 18 wherein said drive means varies the angular velocity of said take-up spool so that said ribbon travels at a constant linear velocity between said supply and said take-up spools.

25. A tape transport apparatus as in claim 24 wherein said drive means comprises:

further control means responsive to said third signal for producing a fifth electrical signal bearing a second predetermined relationship to said second signal;

programmable second counter means for producing a pulse each time a number of clock pulses are counted which correspond to said fifth signal; and step motor means for rotating said take-up spool by a predetermined angular displacement for every pulse produced by said second counter means.

26. A tape transport apparatus as in claim 25, wherein said further control means comprises a read only memory storing a plurality of values of said fifth signal, one for each of a plurality of values of said second signal.

27. A tape transport apparatus as in claim 18 wherein said generator means comprises a step motor.

* * * * *